US005799666A

United States Patent [19]

Wu

[11] Patent Number: 5,799,666

[45] Date of Patent: Sep. 1, 1998

[54] POLISHING PLATE

[75] Inventor: Michael Wu, Taipei, Taiwan

[73] Assignee: Keen Perception Industries Inc., Taipei, Taiwan

[21] Appl. No.: 759,617

[22] Filed: Dec. 5, 1996

[51] Int. Cl.[6] ..... A45D 29/18

[52] U.S. Cl. ..... 132/76.4

[58] Field of Search ..... 132/76.4, 76.5; 451/533, 538, 539, 921

[56] References Cited

U.S. PATENT DOCUMENTS

| | | | |
|---|---|---|---|
| 81,986 | 9/1868 | Crane | 451/533 |
| 1,646,848 | 10/1927 | Beach | 132/76.4 |
| 2,410,506 | 11/1946 | Kirchner et al. | 451/539 |
| 3,866,618 | 2/1975 | Tsukamoto | 132/76.4 |
| 4,712,552 | 12/1987 | Pangburn | 132/76.4 |
| 5,082,009 | 1/1992 | Cromer | 132/76.4 |
| 5,609,513 | 3/1997 | Stark | 451/539 |

*Primary Examiner*—Todd E. Manahan
*Attorney, Agent, or Firm*—Bucknam and Archer

[57] ABSTRACT

A polishing plate includes a substrate plate, a double sided adhesive tape, and a polishing piece, the adhesive tape having one side adhering to the substrate plate and the other side adhering to the polishing piece. The substrate plate is made of soft leather material and is substantially elliptical. It may also be bent to have a curved surface when used to polish nail surfaces. The polishing piece includes a base which is a polyethylene film and is shaped like the substrate plate. The base is further coated with silicon carbide and aluminum oxides. The polishing plate may be used to polish nail surfaces so that they appear smooth, bright and fine.

1 Claim, 2 Drawing Sheets

POLISHING PLATE

BACKGROUND OF THE INVENTION (a) Field of the Invention:

The present invention relates generally to a polishing plate, and more particularly to a polishing plate comprising a substrate plate, a double sided adhesive tape and a polishing piece for maintaining nails.

(b) Description of the Prior Art:

In manicure, after clipping the nails, one has to trim the edges with a nail file before applying the nail polish. However, a nail file can be used to trim the edges of the nails only, and cannot be used to polish the surface of the nail. When the nail polish on the nails has faded, which is very unsightly, it will be necessary to remove the old nail polish with a solvent, which is troublesome and relatively costly.

SUMMARY OF THE INVENTION

Accordingly, a primary object of the present invention is to provide a polishing plate for polishing the surfaces of nails as well as trimming the edges of the nails so that the surfaces of nails appear smooth and bright. In order to achieve the above-mentioned object of the present invention, a polishing plate having a layered structure is provided. The polishing plate of the invention essentially comprises a substrate plate, a double-sided adhesive tape and a polishing piece. One side of the adhesive tape is adhered to the substrate plate with the other side thereof adhering to the polishing piece. The substrate plate is made from soft leather material and is substantially elliptical in shape. And in order to match the curved surface of nails, the substrate plate may be configured to have a curved surface. The polishing piece includes a base which is a polyethylene film and shaped like the substrate plate. The base is coated with silicon carbide and aluminum oxide in the form of fine particles in the grade between 4000 and 10000 according to the U.S. Mesh Grade. Due to the fine particles of the polishing piece, the polishing plate of the invention may be used to polish the nails to achieve fine, bright and smooth nail surfaces.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
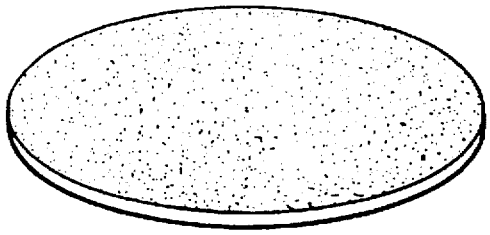
FIG. 1 is an elevational view of the present invention.
Figure 2:
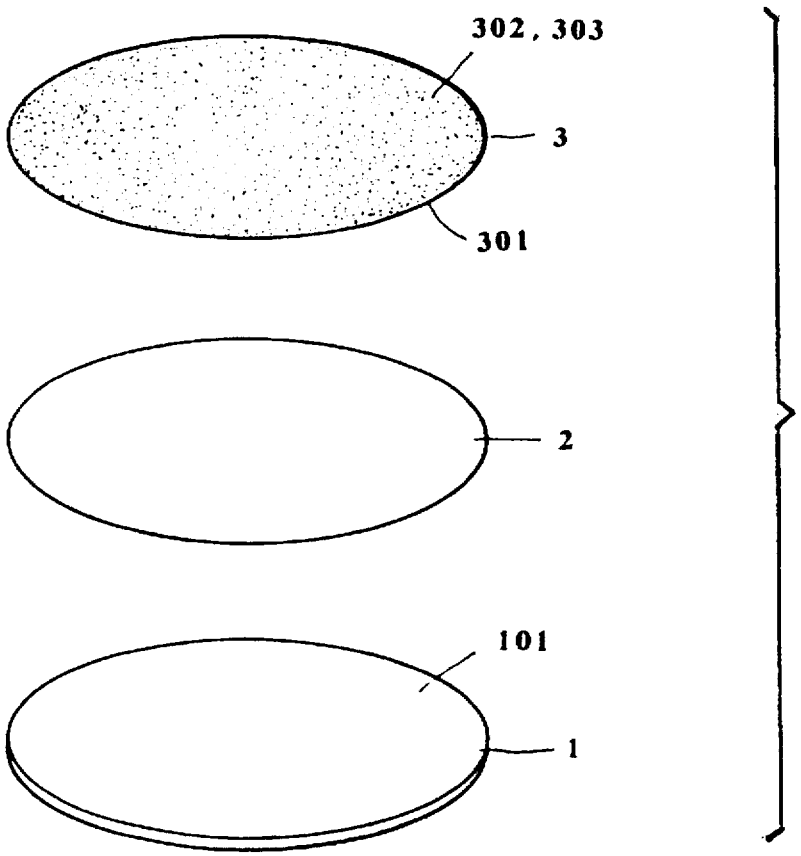
FIG. 2 is an exploded view of the present invention.
Figure 3:
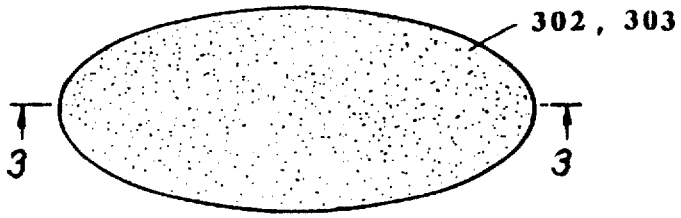
FIG. 3 is a top view of the present invention.
Figure 4:
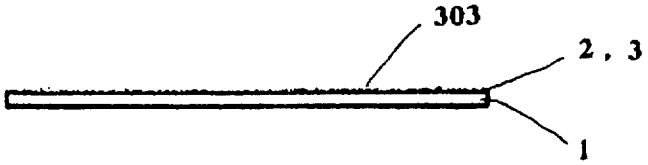
FIG. 4 is a side view of the present invention.
Figure 5:
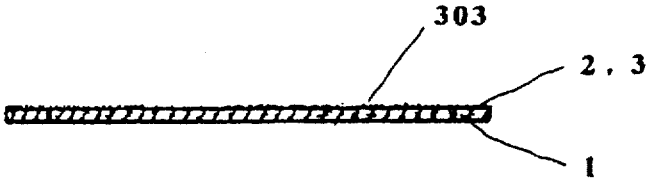
FIG. 5 is a sectional view taken along line A—A of FIG. 3.
Figure 6:
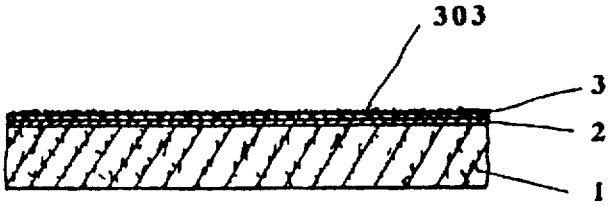
FIG. 6 is a partially enlarged sectional view taken along line A—A of FIG. 3.

With reference to FIG. 1, the polishing plate of the present invention essentially comprises a substrate plate 1, a double sided adhesive tape 2 and a polishing piece 3. One side of the adhesive tape 2 is adhered to the substrate plate 1, with the other side adhering to the polishing piece 3, forming an integral whole. As shown in FIGS. 2–6, the substrate plate 1 which is made of soft leather material is substantially elliptical in shape. It may be bent to have e a curved surface 101 when polishing the nail surfaces. The polishing piece 3 has a bottom side 301 adhering to the other side of the adhesive tape 2. The polishing piece 3 includes a base which is a polyethylene film and is shaped like the substrate plate 1. The base has an upper side 302 has a coated of fine polishing particles 303 composed of silicon carbide and aluminum oxide. The fine polishing particles 303 is of a grade between 4000–10000 according to the U.S. Mesh Grade. The polishing plate of the present invention may be used not only in polishing nails, but it may also be used to polish cuticles.

Although the present invention has been illustrated and described with reference to the preferred embodiment thereof, it should be understood that it is in no way limited to the details of such embodiment but is capable of numerous modifications within the scope of the appended claims.

What is claimed is:

1. A polishing plate comprising a substrate plate, a double sided adhesive tape, and a polishing piece, said adhesive tape having one side thereof adhering to said substrate plate and the other side thereof adhering to said polishing piece, wherein said substrate plate is made of a soft leather material and is substantially elliptical, and said substrate plate may be bent to have a curved surface when used to polish nail surfaces; and said polishing piece comprises a base which is a polyethylene film and is shaped like said substrate plate, said base being coated with silicon carbide and aluminum oxide.

* * * * *